US005857543A

United States Patent [19]

Shalders

[11] Patent Number: 5,857,543

[45] Date of Patent: Jan. 12, 1999

[54] LEDGER TRUSS FOR SCAFFOLDING

[75] Inventor: Alan J. Shalders, North Salem, N.Y.

[73] Assignee: Universal Builders Supply, Inc., Mount Vernon, N.Y.

[21] Appl. No.: 990,949

[22] Filed: Dec. 15, 1997

[51] Int. Cl.[6] ..... E04G 5/00

[52] U.S. Cl. ..... 182/179.1; 182/222

[58] Field of Search ..... 182/119, 222, 182/179.1; 52/223.12, 223.11, 642, 639, 726.2, 731.1

[56] References Cited

U.S. PATENT DOCUMENTS 1,415,554 5/1922 Hatch ..... 182/222

FOREIGN PATENT DOCUMENTS 915440 11/1946 France ..... 182/222

1195581 11/1959 France ..... 182/222

*Primary Examiner*—Alvin Chin-Shue

*Attorney, Agent, or Firm*—Baker & Botts, LLP

[57] ABSTRACT

A ledger truss for scaffolding has a first ledger and a second ledger, each ledger having a longitudinal axis and being of uniform generally "I" shape in cross section along its length. A clamp bracket joins the first and second ledgers end to end at a butt joint with their axes aligned. The upper end of a vertical strut is attached to the clamp bracket, and an end bracket is attached to the end of each ledger remote from the clamp bracket. At least one first tensioned tie bar joins the end bracket on the first ledger to the lower end of the vertical strut, and at least one second tensioned tie bar joins the end bracket on the second ledger to the lower end of the vertical strut.

20 Claims, 3 Drawing Sheets

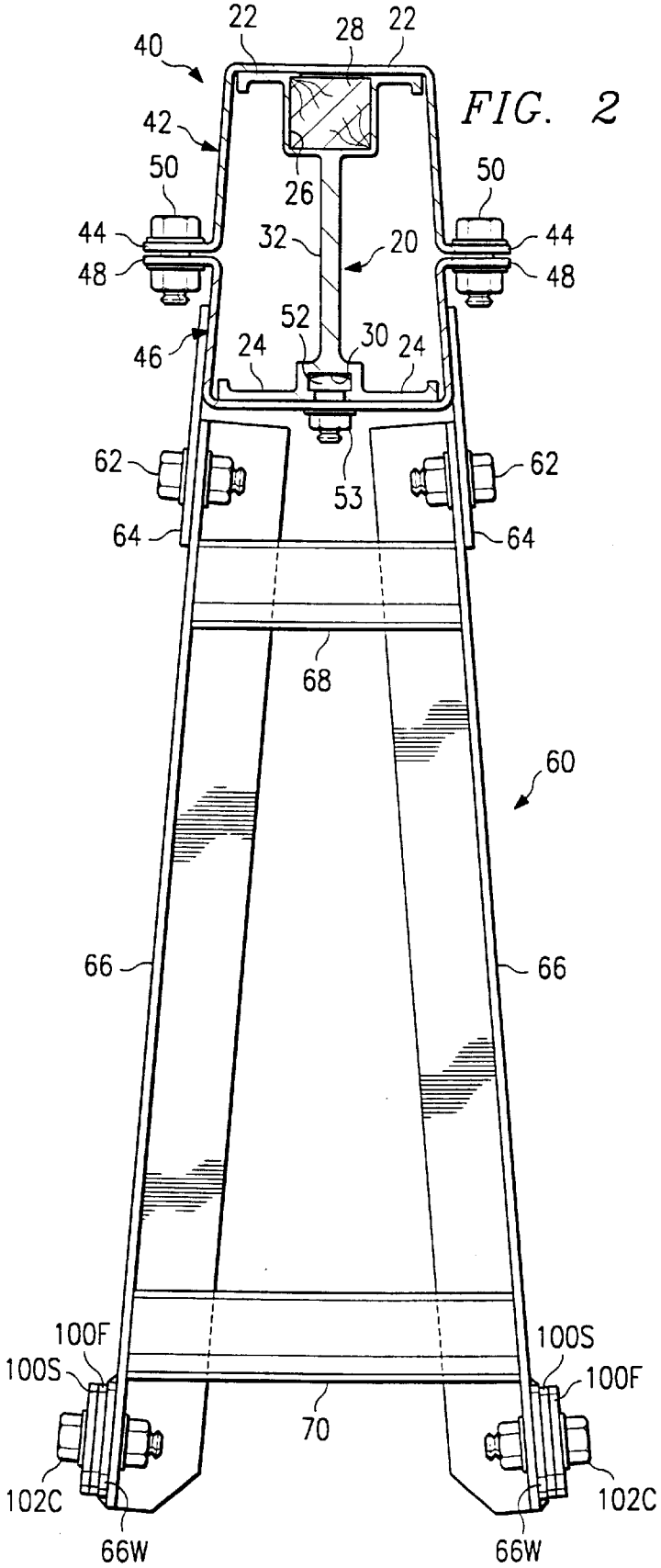
FIG. 2
FIG. 3
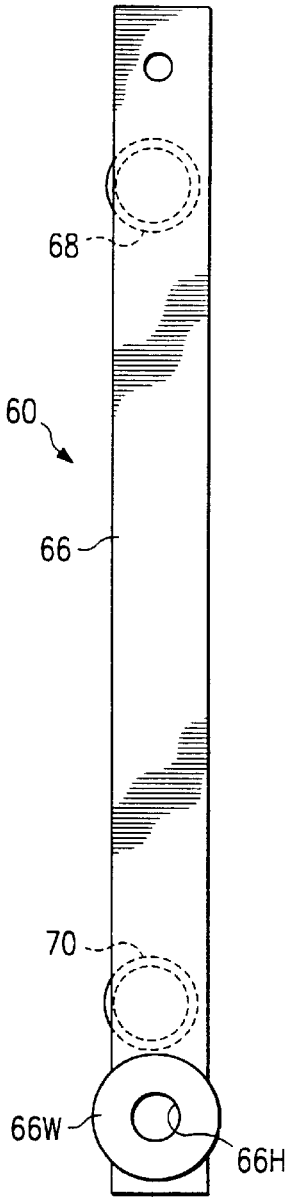

LEDGER TRUSS FOR SCAFFOLDING

BACKGROUND OF THE INVENTION

One form of scaffolding for receiving materials and providing work platforms for workers at selected vertical levels adjacent to a structure being worked on is a modular structural system that includes load-bearing panels stacked vertically and forming vertical columns, horizontal landing channels at each level that are affixed perpendicular to and supported by the columns, and horizontal joists or "ledgers," which are parallel to the columns, perpendicular to the landing channels, and supported by and affixed to the landing channels. Each load-bearing panel is usually a planar truss that has two tubular posts, which are joined by cross members and diagonal braces. The stacks of load-bearing panels that form the columns are arranged in pairs, each column of each pair being parallel to the building face and one column of each pair being closer to the building face than the other. The pairs of columns are spaced apart laterally, and each column is joined to an adjacent column by cross-bracing trusses that are also parallel to the building face.

The modular scaffolding system thus consists of rectangular bays of two forms. One form of bay, a "load-carrying bay," has two sides parallel to the building face, each of which is a stack of load-bearing panels forming a column, and two sides perpendicular to the building face formed by landing channels. Commonly, each landing channel is "sistered" with a cantilevered extension channel, which has a portion coextensive with the landing channel and a cantilevered portion that extends toward the building from the structural bay and supports a cantilevered deck portion of a width of, say, four feet, for workers to move freely from place to place horizontally along the structure being worked on. The other form of bay, a "cross-truss bay," is located between each adjacent pair of load-carrying bays and usually consists of cross trusses that are co-planar with and joined to the stacks of load-bearing panels that form the columns of the adjacent load-carrying bays. The ledgers span both the load-carrying bays and the cross-truss bays. Decking is attached to the ledgers, which receive wood strips to which the decking is attached by nails.

Each vertical load-carrying bay is essentially a hollow vertical tower that is self-supporting, provided that it is suitably fastened to the building at intervals. Therefore, it is possible for a scaffolding to include adjacent load-carrying towers that are independent of each other, that is, not connected by cross-bracing parallel to the building. It is also possible to construct scaffolding composed of units that consist of two or more load-bearing towers, the adjacent towers of each unit being spaced apart and joined by cross-bracing trusses. Adjacent side-by-side towers or multiple tower units may be relatively widely spaced apart, such that standard ledgers are not strong enough to span the spacing. It is, of course, possible to provide special ledgers that are stronger than the standard ledgers to span greater distances between scaffolding towers. Generally, such special, stronger ledgers may not integrate well with a modular system that uses standard ledgers and other standard parts and increase the cost of the scaffolding.

An exemplary scaffolding system is described and shown in U.S. Pat. No. 5,135,077, issued Aug. 4, 1992, and entitled "Scaffolding System," which is hereby incorporated into the present specification for all purposes.

One object of the present invention is to provide a way of supporting decking across spans between adjacent scaffold towers that are spaced so widely apart as to preclude the use of standard ledgers. Another object is to provide long ledger trusses that use standard ledgers and cross tie bars as major components. Still a further object is to provide long ledger trusses that not only use standard ledgers but do so without modifying them in any way, thus permitting the standard ledgers to be used normally or in a ledger truss. It is also desired to provide ledger trusses that integrate readily into a scaffolding system that uses standard ledgers.

SUMMARY OF THE INVENTION

There is provided, an accordance with the present invention, a ledger truss for scaffolding comprising a first ledger and a second ledger, each ledger having a longitudinal axis and being of uniform generally "I" shape in cross section along its length. Such ledgers are known per se, and it is preferred to use standard known ledgers for a ledger truss embodying the present invention. A clamp bracket joins the first and second ledgers end to end at a butt joint with their axes aligned. The upper end of a vertical strut is attached to the clamp bracket, and an end bracket is attached to the end of each ledger remote from the clamp bracket. A first tensioned tie bar joins the end bracket on the first ledger to the lower end of the vertical strut, and a second tensioned tie bar joins the end bracket on the second ledger to the lower end of the vertical strut. The tie bars provide a several-fold increase in the bending strength of the truss, as compared with the bending strength of each ledger alone over the span of the truss. The use of standard ledgers in the ledger truss of the present invention means that the main components of the truss, the ledgers, need not be specially designed, fabricated and stocked and can be used interchangeably in the normal manner or in a ledger truss.

In preferred embodiments, the clamp bracket includes an upper bracket member of generally channel shape in cross section receiving an upper flange of each of the first and second ledgers in nested relation and having outwardly extending edge flanges and a lower bracket member of generally channel shape in cross section receiving a lower flange of each of the first and second ledgers in nested relation and having outwardly extending edge flanges, the upper and lower members being joined by bolts extending through the side flanges. A clamp bracket of this design permits secure end-to-end joinder of the ledgers without requiring any alteration of the ledgers, such as making holes for splicing members, and requires no welding or other permanent affixation between the ledgers. Advantageously, the edge flanges of the upper and lower bracket members are spaced apart and the bolts are tensioned to draw the bracket members toward each other so that the ledgers are clamped firmly between the bracket members.

The upper end of the vertical strut can be pivotally joined to the lower bracket member. Similarly, the first and second tie bars are pivotally joined to the lower end of the vertical strut. At least one of the first and second tie bars is joined to a corresponding end bracket by a threaded draw rod and a bolt, thus allowing the tie bars to be moderately pretensioned to eliminate any looseness in the tie bar/ledger truss unit. The pivoting couplings accommodate small changes in the geometry of the ledger truss resulting from the tightening of the tie bars. It is desirable that each of the first and second tie bars be joined to a corresponding end bracket by a threaded draw rod and a bolt.

The vertical strut may have two vertical members joined together in spaced-apart relation, and there may be two first tie bars and two second tie bars, one end of each of which is attached to the lower end of a respective vertical member of the strut. Such an arrangement permits the tie bars of the truss to be standard tie bars that are ordinarily used for cross-bracing between adjacent vertical columns of the scaffolding. Each of the two first tie bars may be joined to the first end bracket by a single first threaded draw rod and a bolt and each of the two second tie bars may, similarly, be joined to the second end bracket by a single threaded draw rod and a bolt. Each draw rod simultaneously tensions both of the tie bars that are joined to it.

It is desirable, though not essential, that the vertical members diverge downwardly and outwardly with respect to the clamp bracket, thus spacing the lower ends of the vertical members widely apart so that the respective pairs of tie bars diverge from the respective end brackets to attachment points at the lower ends of the vertical members for enhanced lateral stiffness of the ledger truss.

A ledger truss similar to the one described generally above may have three ledgers joined end to end by two clamp brackets, one at each end of the middle ledger, a vertical strut attached to each clamp bracket, and three tie bars (or pairs of tie bars), one joining the two vertical struts, and one joining each vertical strut to an end bracket on each of the end ledgers of the group of three ledgers.

For a better understanding of the present invention, reference may be made to the following description of exemplary embodiments, taken in conjunction with the accompanying drawings.

DESCRIPTION OF THE DRAWINGS

FIG. 2 is an end cross-sectional view of the ledger truss of FIG. 1, taken along the lines 2—2 of FIG. 1;

FIG. 3 is a side elevational view of the vertical strut;

DESCRIPTION OF THE EMBODIMENTS

Figure 1:
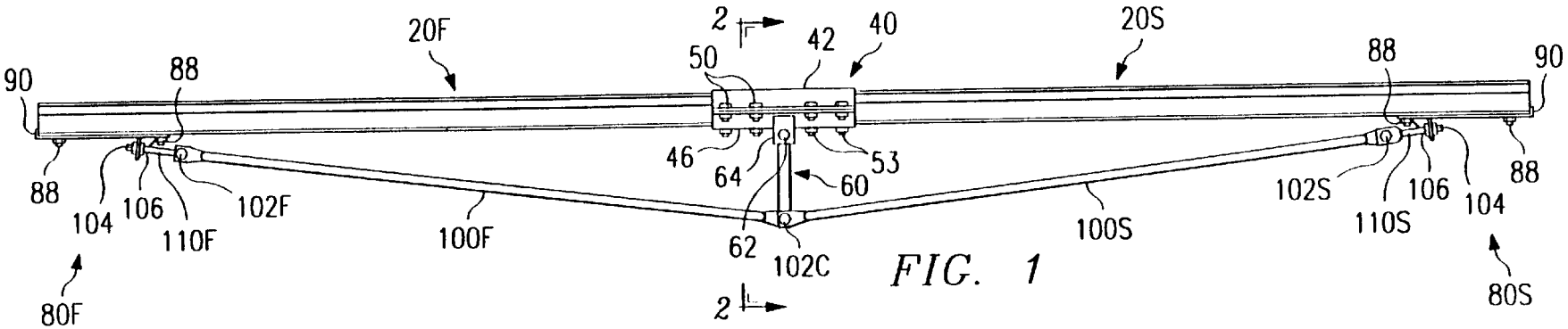
FIG. 1 is a side elevational view of an embodiment of a ledger truss that has two standard ledgers joined end to end.

The embodiment shown in FIGS. 1 to 6 has a first ledger 20F and a second ledger 20S, each ledger having a longitudinal axis and being of uniform generally "I" shape in cross section along its length and being extruded from aluminum. Such ledgers are known per se, and it is preferred to use standard known ledgers for a ledger truss of the present invention. As best seen in FIG. 2, the ledgers 20F and 20S have a pair of upper side flanges 22, a pair of lower side flanges 24, a U-shaped cavity 26 between and joined to the upper flanges 22 that receives a wood nailing strip 28, to which decking is nailed, a bolt-head groove 30 between the lower flanges 24, which receives and captures the heads of bolts that in the usual use of the ledger join the ledger to the landing channels of the scaffolding, and a web 32 connecting the cavity 26 and the groove 30.

A two-part clamp bracket 40 joins the first and second ledgers 20F and 20S end to end at a butt joint with their axes aligned. An upper bracket part 42 of "U" shape (inverted as installed) in cross section and having outwardly extending side flanges 44 receives the upper flanges 22 of end portions of the two ledgers 20F and 20S in nested relation. Similarly, a lower bracket part 46 of "U" shape in cross section and having outwardly extending side flanges 48 receives the lower flanges 24 of end portions of the two ledgers 20F and 20S in nested relation. The bracket parts 42 and 46 are dimensioned so that when the bracket 40 is installed on the ledgers, the flanges 44 and 48 are spaced apart a small distance. The bolts/nuts/washers 50 by which the bracket parts are joined draw the bracket parts toward each other and firmly clamp them to the ledgers. Bolts 52 are received in the bolt-head grooves 30 of the ledgers, pass through holes in the lower bracket part 46, and receive nuts/washers 53, thus to fasten the lower bracket part to the two ledgers 20F and 20S.

The upper end of a vertical strut 60 is fastened by bolts/nuts/washers 62 to attachment plates 64 that are welded to the side walls of the lower clamp bracket part 46. The vertical strut 60 consists of a pair of angle members 66 that are joined by welding to cross pieces 68 and 70, which may be cut from scaffold tubing. Advantageously, the angle members 66 diverge downwardly and outwardly with respect to the lower clamp bracket part 46, thus spacing the lower ends widely apart so that the pairs of tie bars (described below) diverge from near the ends of the ledgers to their attachment points at the respective lower ends of the members 66. That arrangement enhances the lateral stiffness of the ledger truss.

The free end of each ledger 20F, 20S receives an end bracket 80F, 80S. Each end bracket 80 (see FIGS. 5 and 6) is a welded assembly that consists of a base plate 82, an end plate 84, and two gussets 86 for bracing the end plate so that it can carry relatively large loads. The base plate 82 is clamped to the lower flanges 24 of the ledger 20 by bolts/nuts/washers 88, the bolts being received in the bolt head groove 30 of the ledger and passing through holes (not shown)in the base plate. An upturned end lip 90 on the base plate 82 keeps the end bracket from being pulled axially along the ledger toward the clamp bracket by the tension of the tie bars (see immediately below).

One end of each of a pair of first tie bars 100F is connected by a bolt/nut/washer 102F to a draw bar 110F, which is, in turn, connected to the end bracket 80F. Similarly, one end of each of a pair of second tie bars 100S is connected by a bolt/nut/washer 102S to a draw bar 110S, which is connected to the end bracket 80S. Each of the tie bars 100 is, preferably, a standard scaffolding tie bar that is normally used for cross bracing between the vertical load-bearing panels and consists of a piece of tubing having eye-plates welded to each end.

Each draw bar 110 is a piece of threaded rod having an eye-plate welded to one end. The threaded rod passes through a hole 84H (FIG. 6) in the end plate 84 of the end bracket 80, is drawn tight by a tensioning nut 104, and is affixed by a lock nut 106. The other ends of the tie bars 100F, 100S are connected by bolts/nuts/washers 102C to the lower ends of the angle members 66 of the vertical strut, one of each pair 100F and 100S of tie bars being connected to each angle member 66 (see FIG. 2). The holes 66H for the bolts 102C are strengthened by welding a washer 66W to each angle member 66 (see FIG. 3).

The ledger truss can be delivered to a job in pieces and assembled on site. Two ledgers are selected and two bolts are slid into the bolt-head grooves 30 in each end of each ledger. The ledgers are placed end to end and upside down on a flat surface with the butted ends nested in the upper part 42 of the clamp bracket 40. The end brackets 80 are installed and the nuts 88 slightly tightened. The lower clamp bracket part 46, which may already have the vertical strut 60 installed (the lower bracket part 46 and vertical strut 60 form a unit, which need not be disassembled at any time), is assembled with the bolts 52 to the ledgers and with the bolts 50 to the upper bracket part 42, all bolts being tightened only slightly. The tie bars 100 are installed and moderately tensioned using the draw bars 110 to ensure that the end plates and butt joint are pulled tight. All of the bolts/nuts are then tightened securely.

Figure 7:
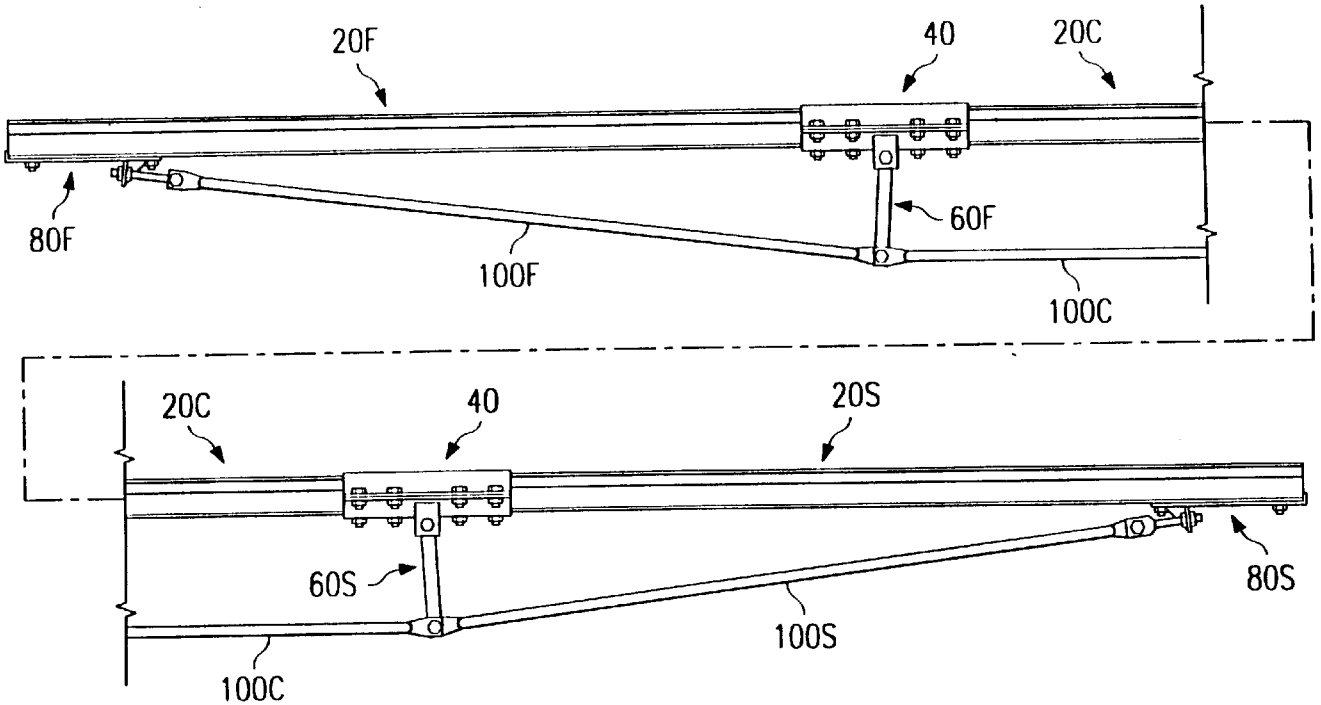
FIG. 7 is a side elevational view of an embodiment of a ledger truss that has three standard ledgers joined end to end.
Figure 4:
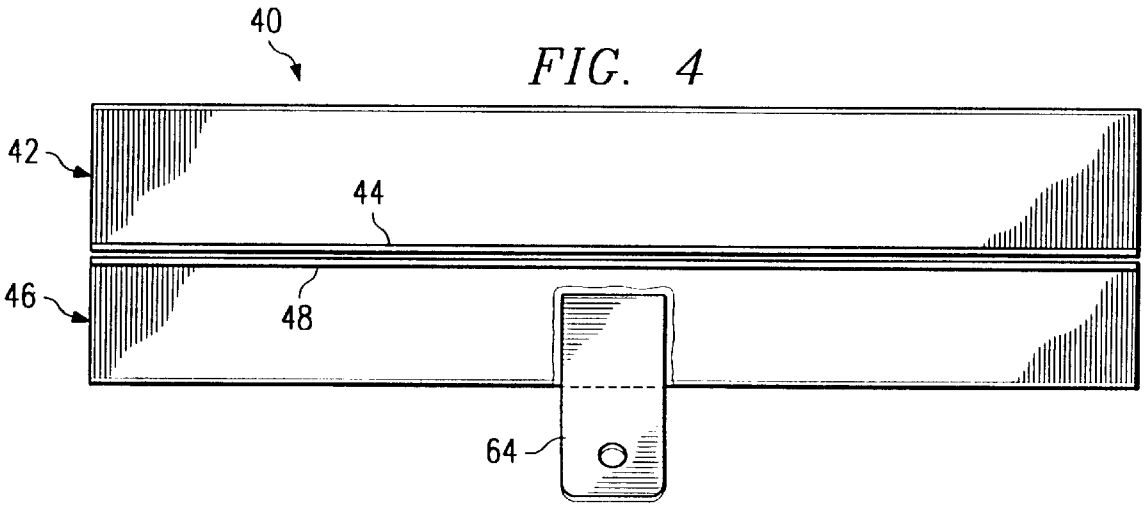
FIG. 4 is a side elevational view of the clamp bracket.
Figure 5:
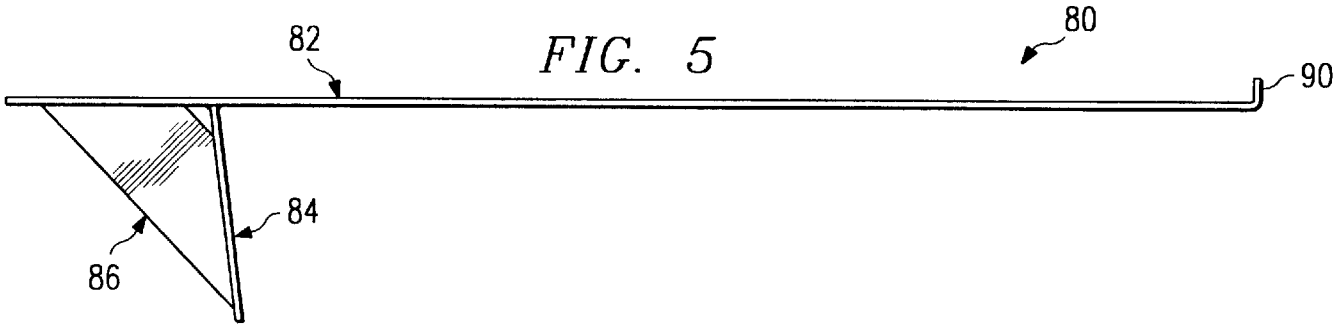
FIG. 5 is a side elevational view of the end bracket.
Figure 6:
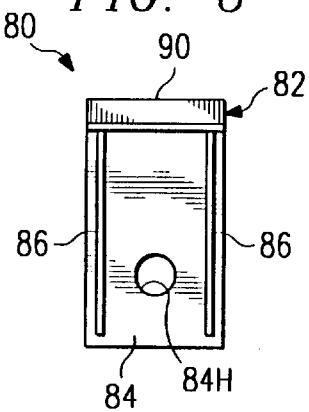
FIG. 6 is an end view of the left end of the end bracket, with respect to FIG. 5.

The ledger truss shown in FIG. 7 is the same as the one shown in FIGS. 1 to 6, except that it has three ledgers 20F, 20S and 20C, two vertical struts 60F and 60S, and three pairs of tie bars 100F, 10S, and 100C. The structure can be clearly understood in the light of the foregoing description and the drawing figure.

The ledgers used in the trusses described above and shown in the drawings are 16 feet in length. The vertical strut is about two feet in height. The clamp bracket is 2'–6" long and the end brackets are 2'–10" long. The two-legder truss (FIG. 1) has a span of 32 feet; the three-ledger truss (FIG. 7) has a span of 48 feet.

I claim:

1. A ledger truss for scaffolding, comprising a first ledger and a second ledger, each ledger having a longitudinal axis and being of uniform generally "I" shape in cross section along its length;

a clamp bracket joining the first and second ledgers end to end at a butt joint with their axes aligned, the clamp bracket being generally tubular and receiving end portions of the first and second ledgers within it in telescoping relation;

a vertical strut having an upper end joined to the clamp bracket and a lower end spaced apart from the clamp bracket;

a first end bracket joined to an end of the first ledger remote from the butt joint;

a second end bracket joined to an end of the second ledger remote from the butt joint;

at least one first tensioned tie bar joining the first end bracket to the lower end of the vertical strut; and at least one second tensioned tie bar joining the second end bracket to the lower end of the vertical strut.

2. A ledger truss according to claim 1 wherein the clamp bracket includes an upper bracket member of generally channel shape in cross section receiving an upper flange of the end portion of each of the first and second ledgers in nested relation and having outwardly extending edge flanges and a lower bracket member of generally channel shape in cross section receiving a lower flange of the end portion of each of the first and second ledgers in nested relation and having outwardly extending edge flanges, the upper and lower members being joined by bolts extending through holes in the side flanges and received on the bolts.

3. A ledger truss according to claim 2 wherein the edge flanges of the upper and lower bracket members are spaced apart and the bolts are tensioned by the nuts to draw the bracket members toward each other so that the ledgers are clamped between the bracket members.

4. A ledger truss according to claim 3 wherein the upper end of the vertical strut is pivotally joined to the lower bracket member by a single bolt/nut that is tightened after the tie bars are moderately tensioned.

5. A ledger truss according to claim 4 wherein the first and second tie bars are pivotally joined to the lower end of the vertical strut by a single bolt/nut that is tightened after the tie bars are moderately tensioned.

6. A ledger truss according to claim 5 wherein at least one of the first and second tie bars is joined to a corresponding end bracket by a threaded draw rod and a nut threaded onto the draw rod.

7. A ledger truss according to claim 5 wherein each of the first and second tie bars is joined to a corresponding end bracket by a threaded draw rod and a bolt and a nut threaded onto the draw rod.

8. A ledger truss according to claim 1 wherein the vertical strut has two vertical members joined together in spaced-apart relation and wherein there are two first tie bars and two second tie bars.

9. A ledger truss according to claim 8 wherein the vertical members diverge downwardly and outwardly with respect to the clamp bracket, thus spacing the lower ends of the vertical members widely apart so that the respective pairs of tie bars diverge from the respective end brackets to attachment points at the lower ends of the vertical members for enhanced lateral stiffness of the ledger truss.

10. A ledger truss according to claim 8 wherein each of the first tie bars is joined to the first end bracket by a single first threaded draw rod and a nut and each of the two second tie bars is joined to the second end bracket by a single threaded draw rod and a nut.

11. A ledger truss for scaffolding, comprising a first ledger, a second ledger, and a third ledger, each ledger having a longitudinal axis and being of uniform generally "I" shape in cross section along its length;

a first clamp bracket joining the first and second ledgers end to end at a first butt joint with their axes aligned;

a second clamp bracket joining the second and third ledgers end to end at a second butt joint with their axes aligned;

each of the first and second clamp brackets being generally tubular and receiving end portions of the ledgers within it in telescoping relation;

a first vertical strut having an upper end joined to the first clamp bracket and a lower end spaced apart from the first clamp bracket;

a second vertical strut having an upper end joined to the second clamp bracket and a lower end spaced apart from the second clamp bracket;

a first end bracket joined to an end of the first ledger remote from the first butt joint;

a second end bracket joined to an end of the third ledger remote from the second butt joint;

a first tensioned tie bar joining the first end bracket to the lower end of the first vertical strut;

a second tensioned tie bar joining the lower end of the first vertical strut to the lower end of the second vertical strut; and a third tensioned tie bar joining the second end bracket to the lower end of the second vertical strut.

12. A ledger truss according to claim 11 wherein the first clamp bracket includes an upper bracket member of generally channel shape in cross section receiving an upper flange of each of the first and second ledgers in nested relation and having outwardly extending edge flanges and a lower bracket member of generally channel shape in cross section receiving a lower flange of each of the first and second ledgers in nested relation and having outwardly extending edge flanges, the upper and lower members being joined by bolts extending through the side flanges, and the second clamp bracket includes an upper bracket member of generally channel shape in cross section receiving an upper flange of each of the second and third ledgers in nested relation and having outwardly extending edge flanges and a lower bracket member of generally channel shape in cross section receiving a lower flange of each of the second and third ledgers in nested relation and having outwardly extending edge flanges, the upper and lower members being joined by bolts extending through the side flanges.

13. A ledger truss according to claim 12 wherein the edge flanges of the upper and lower bracket members of each of the first and second clamp brackets are spaced apart and the bolts are tensioned by nuts to draw the bracket members toward each other so that the ledgers are clamped between the bracket members.

14. A ledger truss according to claim 13 wherein the upper end of each of the first and second vertical struts is pivotally joined to the lower bracket member of a respective first and second clamp bracket.

15. A ledger truss according to claim 14 wherein each of the first and third tie bars is pivotally joined to the lower end of a respective vertical strut.

16. A ledger truss according to claim 15 wherein at least one of the first and third tie bars is joined to a corresponding end bracket by a threaded draw rod and a nut.

17. A ledger truss according to claim 16 wherein each of the first and third tie bars is joined to a corresponding end bracket by a threaded draw rod and a nut.

18. A ledger truss according to claim 11 wherein each vertical strut has two vertical members joined together in spaced-apart relation and wherein there are two first tie bars, two second tie bars, and two third tie bars.

19. A ledger truss according to claim 18 wherein each of the two first tie bars is joined to the first end bracket by a single first threaded draw rod and a nut and each of the two third tie bars is joined to the second end bracket by a single threaded draw rod and a nut.

20. A ledger truss according to claim 18 wherein the vertical members of each vertical strut diverge downwardly and outwardly with respect to the clamp bracket, thus spacing the lower ends of the vertical members widely apart so that the respective first and second pairs of tie bars diverge from the respective end brackets to attachment points at the lower ends of the vertical members and the third tie bars are spaced apart for enhanced lateral stiffness of the ledger truss.

* * * * *